United States Patent [19]

Jamet

[11] 4,122,319

[45] Oct. 24, 1978

[54] ELECTRICAL SWITCH AND ITS USE FOR THE CONTROL OF MACHINES

[75] Inventor: Michel Jamet, Sesto-Calende, France

[73] Assignee: Euratom, Luxembourg

[21] Appl. No.: 780,803

[22] Filed: Mar. 24, 1977

[51] Int. Cl.[2] ..... H01H 3/00

[52] U.S. Cl. ..... 200/153 J; 200/159 R

[58] Field of Search ..... 200/159 R, 153 J, 153 H, 200/153 G

[56] References Cited

U.S. PATENT DOCUMENTS

| | | | |
|---|---|---|---|
| 1,784,437 | 12/1930 | Harlow | 200/153 J |
| 2,335,283 | 11/1943 | Johnson | 200/159 R |
| 2,942,073 | 6/1960 | Barr | 200/153 H |
| 3,731,030 | 5/1973 | Holzer | 200/159 R |
| 3,809,838 | 5/1974 | Coppola | 200/159 R |

FOREIGN PATENT DOCUMENTS

| | | | |
|---|---|---|---|
| 492,354 | 3/1954 | Italy | 200/159 |

*Primary Examiner*—Stephen P. Garbe

*Attorney, Agent, or Firm*—Stevens, Davis, Miller & Mosher

[57] ABSTRACT

An electrical switch comprising a housing containing a linearly movable spring-loaded control element, *n* contacts each comprising a fixed element mounted in the housing and a movable element carried by the control element. The contacts are arranged such that upon progressive travel of the control element from its initial position each of the movable elements in turn makes contact with its associated fixed element at a respective operative position of the control element, the movable elements of the 1st to the (*n*-1)th contacts comprising respective arms pivotally connected to the control element. Each of the respective arms are arranged such that, in use, after making contact with its associated fixed element it cooperates with a respective first abutment means and is pivoted from its normal working position into a non-working position in which it remains, spaced from its associated fixed element, until, upon return of the control element to its initial position, it cooperates with a respective second abutment means arranged to return it to its normal working position without making contact with its associated fixed element. Consequently, when the control element is, in use, released and returns to its initial position there is no "re-making" of any contacts which were made and broken when the control element was actuated to move away from its initial position.

10 Claims, 7 Drawing Figures

ELECTRICAL SWITCH AND ITS USE FOR THE CONTROL OF MACHINES

This invention relates to electrical switches.

According to the present invention there is provided an electrical switch comprising a housing containing a linearly movable spring-loaded control element, *n* contacts each comprising a fixed element mounted in the housing and a movable element carried by the control element, the contacts being arranged such that upon progressive travel of the control element from its initial position each of the movable elements in turn makes contact with its associated fixed element at a respective operative position of the control element, the movable elements of the 1st to the $(n-1)$th contacts comprising respective arms pivotally connected to the control element, each of the respective arms being arranged such that, in use, after making contact with its associated fixed element it cooperates with a respective first abutment means and becomes pivoted from its normal working position into a non-working position in which it remains, spaced from its associated fixed element, until, upon return of the control element to its initial position, it cooperates with a respective second abutment means arranged to return it to its normal working position without making contact with its associated fixed element, whereby when the control element is, in use, released and returns to its initial position there is no "re-making" of any contacts which were made and broken when the control element was actuated to move away from its initial position.

The control element may carry respective releasable catch means arranged to maintain releasably the associated arm in its normal working position and its non-working position, alternately. Preferably each of the respective releasable catch means is in the form of a pair of spring-loaded pins disposed on opposite sides of the associated arm.

Conveniently each of the respective first abutment means is constituted by the corresponding fixed element.

Each of the respective second abutment means may be constituted by a respective internal shoulder of the housing.

The respective arms may be staggered with respect to each other along the direction of travel of the control element. Alternatively, they may be disposed in the same switching plane.

Preferably each of the respective arms carries a contact bridge, and each of the associated fixed elements is in the form of respective spaced pairs of contact members arranged to be coupled by their associated contact bridge. More preferably, each of the contact bridges has a pair of depressions arranged to cooperate with a respective complementary shaped projection on each of the associated contact members.

The respective spacings of the associated fixed and movable contact elements may be in an arithmetical progression in which the difference of the terms is equal to the first term. By this arrangement the operative positions of the switch are uniformly spaced.

A preferred embodiment of the invention will now be described by way of example with reference to the accompanying drawing in which.

Figure 6:
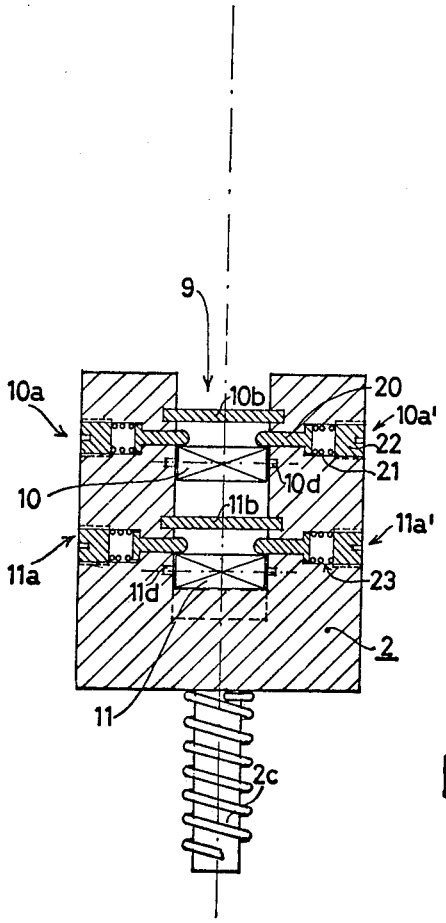
Figure 7:
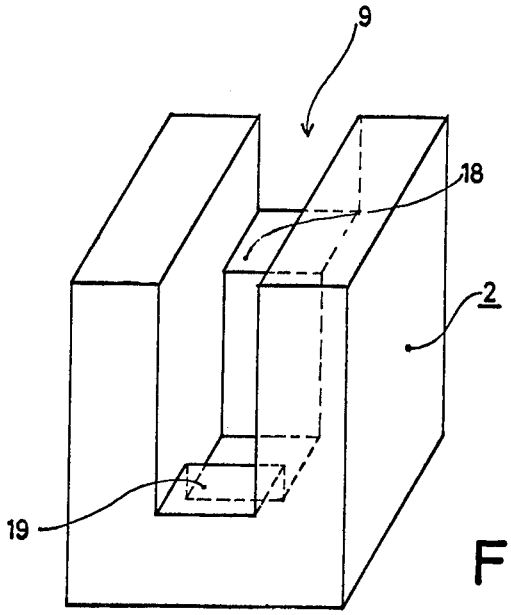

FIGS. 6 and 7, respectively, are a front view and a view in perspective of the movable control element.

In FIGS. 1 to 4 there is designated by 1 a switch housing comprising a pot-shaped part 1*a* and a cover 1*b;* the numeral 2 designates a movable control element formed by a body 2*a,* a pushbutton 2*b* projecting externally of the switch housing, and a guide rod 2*c;* in addition, the numerals 3*a* to 3*c* designate the respective fixed contact elements associated with first, second and third operative positions of the control element and 4 designates a return spring. The housing and the control element are made of electrically insulating material and are so shaped that when an operating force is applied to the pushbutton the control element moves linearly, without rotation, against the pressure exerted by the return spring 4. The cover 1*b* is fastened by means of countersunk screws 5 to the part 1*a* of the housing and acts to limit the operating travel of the control element in the direction of the pushbutton (zero position). The return spring is disposed in a hole 6 in the part 1*a* of the housing and an adjuster screw 7 is provided in the end of hole 6 for adjusting the force exerted on the control element by the return spring. The resetting force has to be greater than the locking force exerted by the catches.

Inside the pot-shaped part 1*a* of the housing there is provided a control chamber 8 comprising two recesses (pockets) 8*a* and 8*b* which are provided in the wall of the housing part 1*a.* The control chamber and its recesses are of rectangular cross-section in all three sectional planes. There is provided in the movable control element 2 a recess 9 which is shown in detail in FIG. 7. The recess 9 is closed at its top part by a base plate 2*d* of the pushbutton 2*b,* which is connected to the control element 2*a.* The control element carries at its lower end a pair of movable contact elements 3*c'* for bridging an associated pair of fixed contact elements 3*c.*

Figure 3:
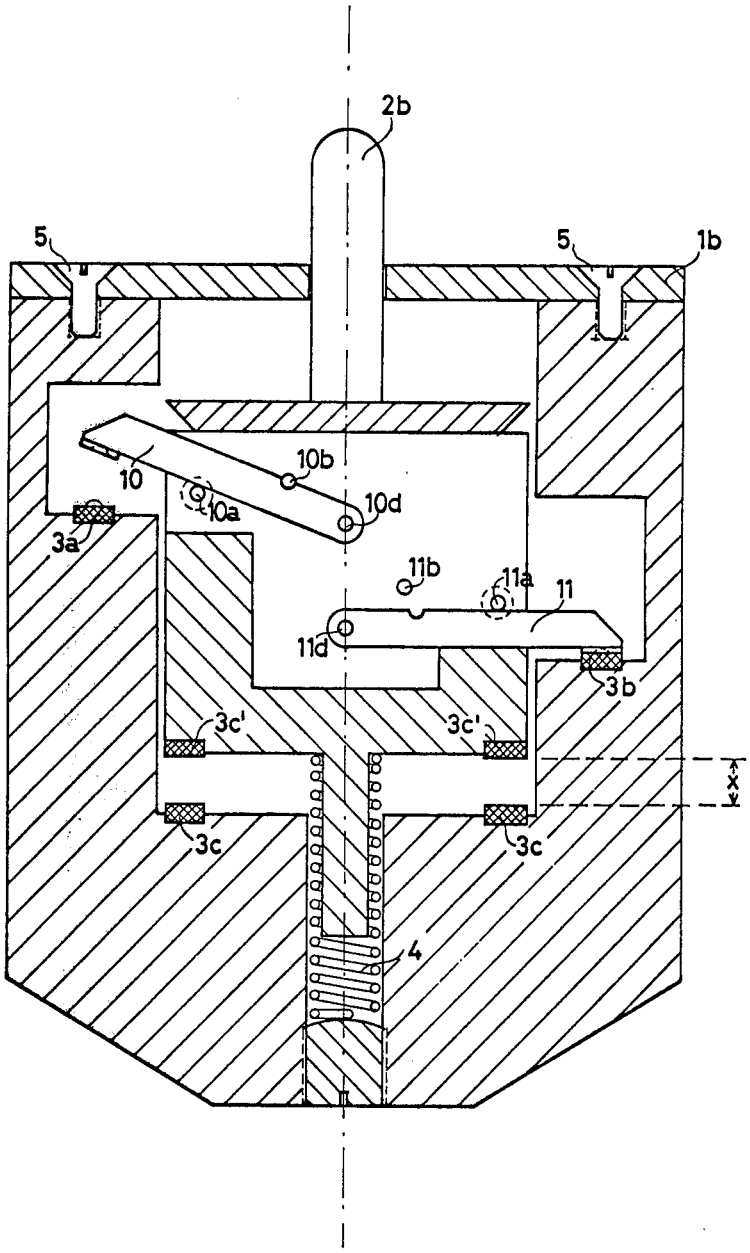

The movable contact elements of the control element 2 associated with its first and second operative positions are in the form of pivotable arms 10, 11 which, during the passage between the first and second operative positions, are brought into an inclined position as shown in FIG. 3, and with which there are associated, within their path of movement a releasable catch means 10*a,* 11*a* respectively, and stop members 10*b,* 11*b,* respectively, mounted on the control element. The contact elements 3*a* and 3*b* constitute respective first abutment means, and the internal shoulders 10*c,* 11*c* constitute respective second abutment means: the first abutment means deactivates the pivotable arms by causing them to pivot from their normal working positions into their inclined, non-working positions, and the second abutment means reactivate the arms to their working positions. The arms 10, 11 are rotatably mounted about pivots 10*d,* 11*d* firmly attached to the control element 2*a.*

The spacings between the fixed and movable contact elements associated with the three operative positions - and thus, correspondingly, between the abutment means - are so chosen, relative to the preceding spacing, to increase linearly by the distance corresponding to the initial spacing of the contact associated with the first operative position (designated by X), i.e. in accordance with the distances X, 2X and 3X. In this way the pivotable arm does not prevent the movement of the control element in any of its positions.

Figure 5:
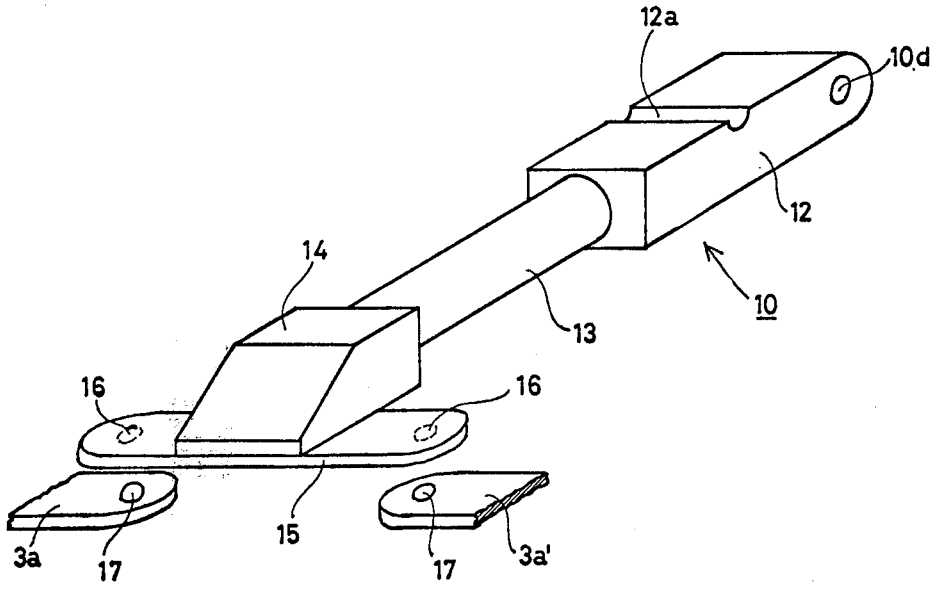
FIG. 5 is a view in perspective of a pivotable arm.

Before a description of the mode of operation of the electrical switch, there will firstly be explained, with reference to FIGS. 5 to 7, the arrangement of the arms and of the corresponding movable control elements as well as details of the releasable catch means, stop members and pivot mountings.

In FIG. 5 there is shown one of the arms which comprises a base and support 12 of rectangular section, a second part in the form of a cylindrical shank 13 and a third part in the form of a generally rectangular head part 14. The base part has a groove 12*a* for the engagement of the stop member 10*b* (FIG. 1); the shank part cooperates with the releasable catch means 10*a* (FIG. 1), and the head part carries a contact bridge 15, in whose bottom zone there are provided concave recesses 16. These recesses serve to make mating contact with lenticular bosses 17 which are provided on the fixed contact elements 3*a*, 3*b* (FIG. 1), which are provided as respective pairs of contact elements 3*a*, 3*a'* spaced normally to the plane of the drawing.

Figure 1:
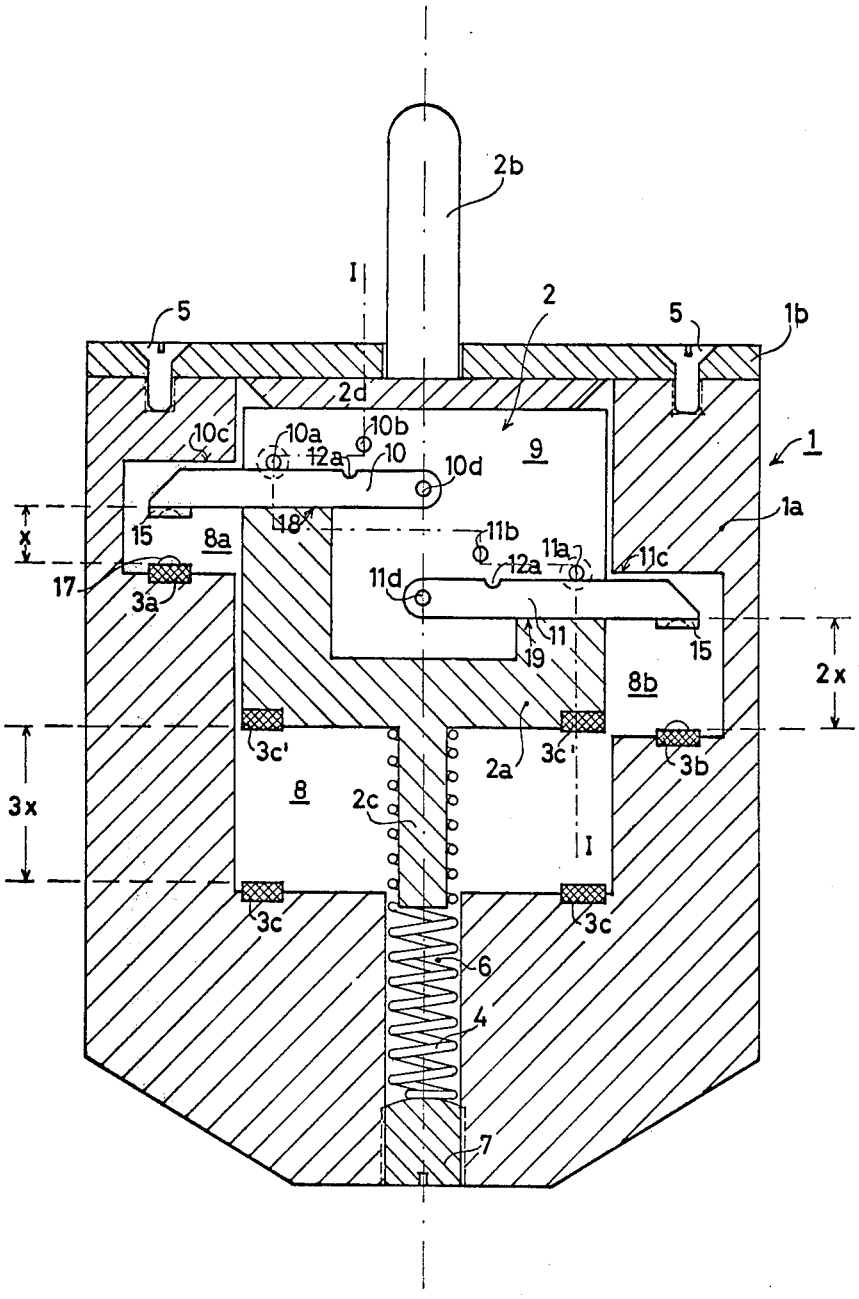
FIGS. 1, 2, 3 and 4 illustrate an electrical switch having three operative positions, and wherein the movable contact elements associated with the first and second operative positions are in the form of pivotable arms staggered in relation to one another, the various operational positions being shown by vertical sections through the switch.
Figure 2:
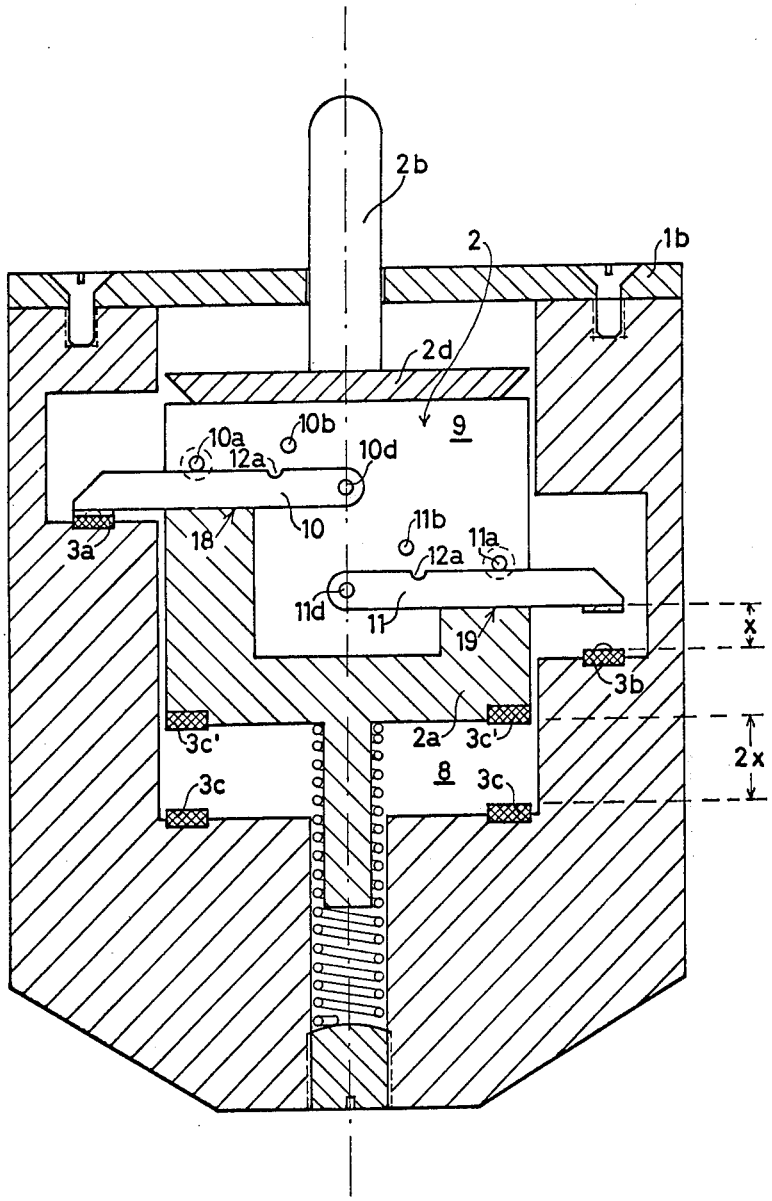

In FIG. 6 the arms are mounted in the common pocket-like recess 9 and are disposed with their lower edges, against the surfaces 18 and 19 (FIG. 1 and 7). They are held in this position by the aforementioned releasable catch means, which as shown in FIG. 6, are in the form of pairs of opposed catches 10*a*, 10*a'*, and 11*a*, 11*a'*.

Each individual catch comprises a pin 20 rounded towards its front and having an enlarged rear end portion which is subjected to the pressure exerted by a respective coil spring 21. This spring is itself held in position in a respective hole 23 in the control element 2 by an adjusting screw 22 mounted in the end of hole 23.

The catch pins are arranged such that when the arm is in its working position their rounded heads lie against the upper side of the cylindrical shank 13 (FIG. 5), so that the arm can only be pivoted upwards if it is urged against the pin heads with such a force that its resolved component directed along the pins exceeds the forces applied to the pins by spring 23. The arms are thus releasably retained in their horizontal initial positions by the above-described catch arrangement.

Figure 4:
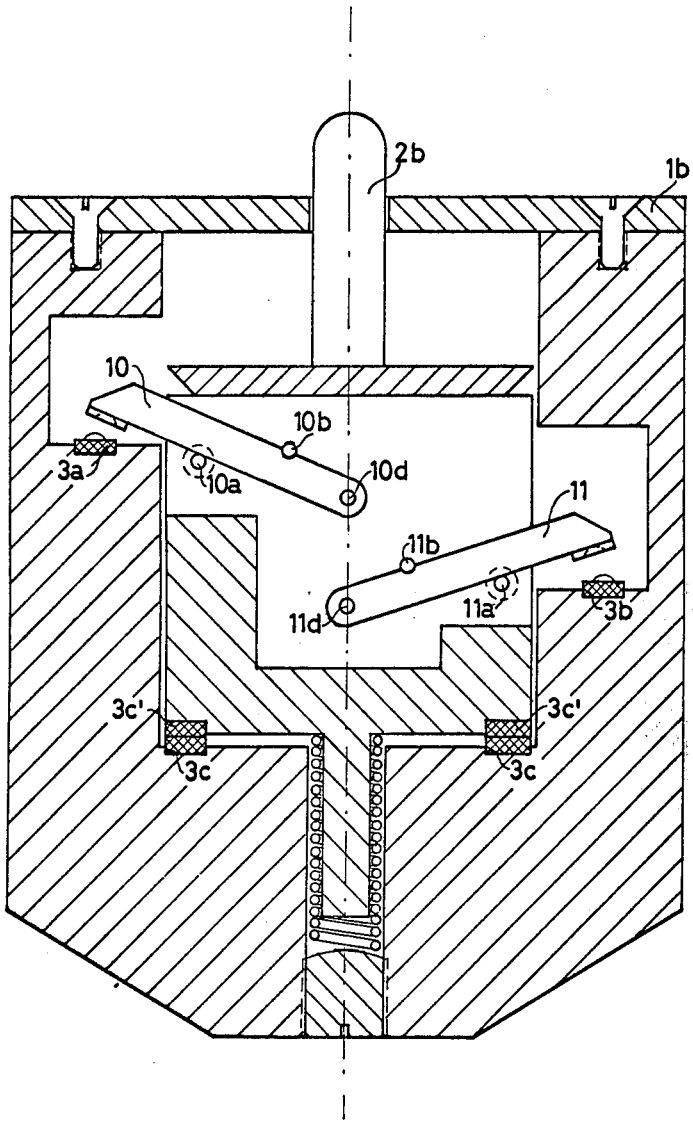

The mode of operation of the electrical switch will now be described with reference once more to FIGS. 1 to 4. Under the action of finger pressure exerted by the operator, the control element is displaced downwards, as shown in the drawings, from the starting position shown in FIG. 1, to reach the first operative position shown in FIG. 2, in which the fixed contact elements are bridged by the contact bridge at the end of the arm 10. If this downward pressure is maintained, the retaining force of the releasable catch means 10*a*, 10*a'* is overcome and the arm 10 passes abruptly into the inclined position shown in FIG. 3. As a result of the concave-convex conformation of the corresponding parts of the contact elements 3*a*, 3*a'* and 15 the entire contact surface is maintained until sudden raising of the arms. The switch is so constructed that simultaneously with the separation at contacts 3*a*, 3*a'* and 15, the arm 11 bridges contacts 3*b* and 3*b'*, at which time the contact elements 3*a*, 3*a'* and 15 are open (FIG. 3). If the control element is depressed further then, finally, reopening of the contact elements 3*b*, 3*b'* takes place and the contact elements 3*c*, 3*c'* are closed (FIG. 4). When the pushbutton is released the control element returns promptly into the starting position, in which case the arms are returned into the horizontal position by coming into abutment with the shoulders 10*c*, 11*c*. The dimensions of the recesses 8*a* and 8*b* provided in the housing and the angle of the inclined position of the rocking levers are so chosen that when an arm has been brought into its inclined position it does not disturb, as mentioned above, the movement of the control element in either direction.

Whereas the above described switch employs pivotable arms which are staggered in relation to one another, it will be appreciated that it is possible to provide the arms one below the other in a column and staggered in respect of one another, or else arms can be used which are not staggered and arranged in pairs on the same level. Furthermore, it is possible to use combination of staggered and non-staggered arms and it is possible to arrange more than two arms in each switching plane.

Whereas the above described switch has three operative positions, it will be appreciated that switches in accordance with this invention can have two operative positions, or more than three such positions, and that, if desired, more than one contact can be provided for actuation at an operative position. In other words, the above reference to *n* contacts operated in sequence means that the switch has *n* operative positions, where *n* is at least two. Furthermore, it will also be understood that this invention is not limited to switches having one contact at each operative position, but encompasses switches where there is more than one contact at each operative position.

In the above switch the abutment means are provided by the contacts 3*a*, 3*b* and the shoulders 10*c*, 11*c*. Alternatively they can be provided by separate elements, such as abutment sections, locking jaws, cam sections, guide grooves etc., which come into engagements or contact in an appropriate manner with the pivotable arms.

The above described switch can be used with particular advantage in control boxes such as that disclosed in French Pat. Specification No. 1,389,212, and there will be achieved a reduction in the number of independent pushbuttons.

From an engonomics point of view it is an important advantage that associated functions e.g. half speed and full speed of a motor or forwards, backwards movement may be assigned to various positions of one control lever. It is however, normally not wanted and sometimes even unacceptable if the functions, which correspond to the first positions the lever reaches when moved from its rest position, are activated when the lever returns from one of the positions it reaches later. This problem can be overcome by means of the switch described above, whereas when normal pushbuttons are used it is necessary to use complicated relay circuits to achieve the same effect.

What we claim is:

1. An electrical switch having a plurality of positions comprising a housing having a control chamber including a plurality of recesses therein;

a plurality of first abutment means and a plurality of second abutment means located within said housing in said recesses, one of said first abutment means and one of said second abutment means being spaced apart within each of said recesses;

a linearly movable spring-loaded control element located within the control chamber of said housing and movable with respect thereto; and a plurality of arms pivotably attached to said control element and extending into corresponding recesses in said housing, each of said arms extending between the first and second abutments within its associated recess in an initial position of said switch, engaging a corresponding one of said first abutment means when said control element is displaced a predetermined amount to a corresponding operative position of said switch and being pivoted away from said first abutment means toward said second abutment means when said control element is displaced a further amount, each of said arms being returned to its nonpivoted position by cooperation with said second abutment means when said control element is restored to said initial position without again contacting said first abutment means.

2. A switch as claimed in claim 1 further comprising releasable catch means attached to said control element for maintaining releasably each of said plurality of arms in its pivoted and non-pivoted position, alternately.

3. A switch as claimed in claim 2 wherein each of said respective releasable catch means is in the form of a pair of spring-loaded pins disposed on opposite sides of its associated arm.

4. A switch as claimed in claim 1 wherein each of said second abutment means consists of a respective internal shoulder of said housing.

5. A switch as claimed in claim 1 wherein said plurality of arms are staggered with respect to each other along the direction of travel of said control element.

6. A switch as claimed in claim 1 wherein said plurality of arms are disposed in the same switching plane.

7. A switch as claimed in claim 1 wherein each of said plurality of arms carries a contact bridge, and each of said first abutment means is in the form of respective spaced pairs of fixed contact members arranged to be coupled to their associated contact bridge.

8. A switch as claimed in claim 7 wherein each of said contact bridges has a pair of depressions arranged to cooperate with a respective complementary shaped projection on each of the associated contact members.

9. A switch as claimed in claim 7 wherein the respective spacings between each contact bridge and its associated fixed contact members are in an arithmetical progression in which the difference of the terms is equal to the first term.

10. A switch as claimed in claim 1 which further comprises at least one fixed contact element secured to said housing within said control chamber and at least one movable contact element secured to said control element, said fixed contact element and said movable contact element being brought into engagement when said control element is displaced to the end of its travel away from said initial position.

* * * * *